United States Patent [19]

Kanno

[11] 4,322,674

[45] Mar. 30, 1982

[54] TRANSISTORIZED VOLTAGE REGULATOR

[75] Inventor: Susumu Kanno, Soma, Japan

[73] Assignee: Alps Electric Co., Ltd., Tokyo, Japan

[21] Appl. No.: 175,951

[22] Filed: Aug. 7, 1980

[30] Foreign Application Priority Data

Aug. 11, 1979 [JP] Japan ..... 54-110845[U]

[51] Int. Cl.[3] ..... G05F 3/18

[52] U.S. Cl. ..... 323/231; 323/267

[58] Field of Search ..... 307/11, 12, 318; 323/231, 267, 303, 304, 311

[56] References Cited

U.S. PATENT DOCUMENTS 3,376,489 4/1968 Crayton ..... 307/11 X 4,052,660 10/1977 Shuey .

FOREIGN PATENT DOCUMENTS 427326 2/1975 U.S.S.R. ..... 323/267

*Primary Examiner*—William M. Shoop

*Attorney, Agent, or Firm*—Guy W. Shoup; Gerard F. Dunne

[57] ABSTRACT

A transistorized voltage regulator has two outputs, one for high current loads and another for low current loads, to minimize drift of the output.

1 Claim, 2 Drawing Figures

TRANSISTORIZED VOLTAGE REGULATOR

BACKGROUND OF THE INVENTION

The present invention relates to a transisterized voltage regulator, and more particularly to a regulator having two output terminals for use in, for example, a tuner of the electronic tuning type.

A typical voltage regulator is shown in FIG. 1, where a single transistor 1 of PNP polarity has its collector electrode connected to an input terminal 2 and its emitter electrode connected to an output terminal 3. The base electrode of the transister 1 is connected through a FET (field effect transistor) circuit 4 to the input terminal and also through a zener diode 5 to the ground. The FET has its gate and source electrodes connected to the input terminal 2 and its drain electrode connected to the base electrode of the transistor 1. The FET circuit 4 forms a constant current circuit. Numerals 6, 7 and 8 denote respectively a rectifier diode connected to an AC voltage source (not shown), a smoothing capacitor and a tuner having a power supply input voltage of −B at terminal 9. Numeral 10 denotes a potentiometer for electronic tuning through which a very low current of approximately 2 mA will constantly flow while a large current of approximately 100 mA will flow through the tuner 8.

In such a vlotage regulator, however, the output voltage from the output 3 is applied to both the tuner 8 and potentiometer 10 and thus drift of the output voltage owing to the temperature characteristics of the transistor 1 may affect the tuning voltage of the potentiometer 10.

SUMMARY OF THE INVENTION

An object of the present invention is to provide a voltage regulator which has two different output terminals where one is for high-current and the other is for low-current.

Another object of the present invention is to provide a voltage regulator which can eliminate drift of variable tuning voltage for biasing varactor diodes in a tuner.

Still another object of the present invention is to provide a voltage regulator which has simple configuration.

These and other objects, features and advantages of the present invention are provided by two output terminals extending from the transistor of the voltage regulator. One output delivers high current and the other low current to respective loads.

DESCRIPTION OF THE PREFERRED EMBODIMENT

The present invention will be described in respect to the difference from the conventional example with reference to FIG. 2, wherein the same parts in the above description are attached with the same numerals.

Figure 1:
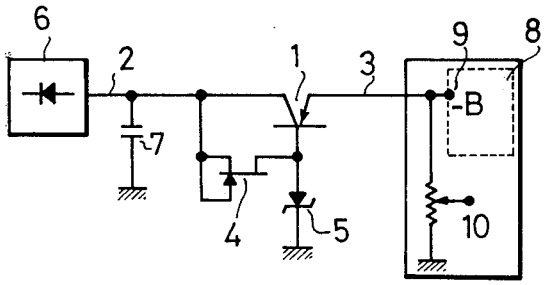
Fig.1 PRIOR ART
FIG. 1 is a circuit schematic of a DC series voltage regulator in accordance with the prior art which is used for an electronic tuner; and, FIG. 2 is a circuit schematic of a DC series voltage regulator in accordance with an embodiment of the present invention.
Figure 2:
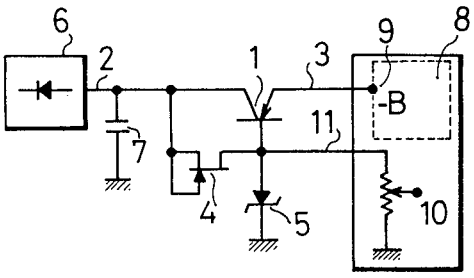

Refering to FIG. 2, the voltage regulator has two out put terminals 3 and 11, where the high-current terminal 3 is for connection to the tuner 8 and low-current terminal 11 for the variable reisistor 10.

In the above described configuration, output voltage value Vout-3 at the terminal 3 and output voltage Vout-11 at the terminal 11 are given by:

$$V_{\text{out-3}} = V_z + V$$

$$V_{\text{out-11}} = V_z$$

where

Vz=zener voltage of zener diode 5

V=base-emitter voltage of transistor 1

Thermal stability of the output voltages depend on the temperature characterestics of the transistor 1 and the zener diode 5 at the terminal 3, and only the zener diode 5 at terminal 11, respectively. Therefore, the output voltage Vout-11 at the terminal 11 may have better thermal stability than that of output voltage Vout-3 at the terminal 3. Additionaly, the current flow through the diode is controlled by the FET circuit 4 to be constant, the zener voltage of the zener diode 5 may be maintained constant. As the result, the stable output voltage for the potentiometer can be easily obtained.

What is claimed is:

1. In a transistorized voltage regulator comprising, a transistor having a collector electrode connected to an input terminal, an emitter electrode connected to an ouput terminal and a base electrode connected to said input terminal through means for providing a constant current, and means including a zener diode connected between the base of said transistor and ground for regulating the voltage to the base of said transistor, the improvement comprising:

a first output terminal connected to said emitter electrode for supplying regulated voltage to a high-power dissipation load; and a second output terminal connected to the base of said transistor for supplying regulated voltage to a low-power dissipation load.

* * * * *